US006550193B2

(12) United States Patent
Potts

(10) Patent No.: US 6,550,193 B2
(45) Date of Patent: Apr. 22, 2003

(54) SPLIT JAMB FOR DOORS AND WINDOWS

(76) Inventor: Thomas Lee Potts, 2907 Mt. Pleasant Rd., Sherrills Ford, NC (US) 28673

( * ) Notice: Subject to any disclaimer, the term of this patent is extended or adjusted under 35 U.S.C. 154(b) by 27 days.

(21) Appl. No.: 09/948,452

(22) Filed: Sep. 7, 2001

(65) Prior Publication Data

US 2003/0046886 A1 Mar. 13, 2003

(51) Int. Cl.[7] ..... E06B 1/04
(52) U.S. Cl. ..... 52/204.1; 52/157; 52/212; 52/211; 29/623.1
(58) Field of Search ..... 52/213, 204.1, 52/211, 217

(56) References Cited

U.S. PATENT DOCUMENTS

| | | | | | |
|---|---|---|---|---|---|
| 3,861,099 | A | * | 1/1975 | Faudree | 52/211 |
| 4,012,868 | A | | 3/1977 | Andruszkiewicz | |
| 4,251,962 | A | * | 2/1981 | Langenhorst | 52/157 |
| 4,259,818 | A | * | 4/1981 | Stark | 52/208 |
| 4,443,984 | A | | 4/1984 | Rasmussen | |
| 4,510,722 | A | | 4/1985 | Van Wieringen | |
| 4,769,948 | A | | 9/1988 | Carmichael | |
| 4,813,204 | A | | 3/1989 | Rentschler | |
| 4,878,325 | A | | 11/1989 | Van Tuyl et al. | |
| 5,437,130 | A | | 8/1995 | Raynak | |
| 5,735,326 | A | | 4/1998 | Seidner | |
| 5,787,660 | A | * | 8/1998 | Adams | 52/212 |

* cited by examiner

*Primary Examiner*—Carl D. Friedman
*Assistant Examiner*—Steve Varner
(74) *Attorney, Agent, or Firm*—Adams, Schwartz & Evans, P.A.

(57) ABSTRACT

A split door jamb having a support frame and a trim frame utilize a unique mounting system. The support frame includes two vertical side frame members connected by a laterally-extending top member. Each side frame member includes a plurality of adjustable fasteners for mounting the side frame members to walls defining a door opening. One frame member has at least one hinge pad for carrying a door or similar object to cover the opening. The support frame carries outwardly-extending tongues and tongue fasteners adjacent to the tongues. The trim frame has two vertical side trim members connected by a laterally-extending top trim member. The trim frame carries a tongue receiving cavities that receive the tongues extending from the support frame. Each trim member also carries fasteners for complementary connection with the support frame fasteners to adjustably connect the trim frame and support frame together.

17 Claims, 6 Drawing Sheets

SPLIT JAMB FOR DOORS AND WINDOWS

TECHNICAL FIELD AND BACKGROUND OF THE INVENTION

The invention relates to a support frame apparatus for supporting doors, windows, vents and other similar objects within an opening in a structure. The apparatus is of the type commonly referred to as a "split door jamb," in which two jamb members are provided with interlocking means and are connected to each other from opposite openings of a doorway. Typically, the jamb members are hollow and metal, and a door is hinged to a side jamb of one of the mating jamb members. The present invention provides an improved split door jamb, and a method of using same. It should be noted that the term "split door jamb" is used in this specification as a reference and is not intended to limit the scope of the invention.

There are basically two distinct types of structures in which split door jambs are used—masonry structures and non-masonry constructed structures. Masonry structures include concrete masonry units, brick, stone, poured in place concrete, pre-cast concrete and any other poured or cast component structure. Non-masonry structures include wood framing, steel framing, composite material framing, and any other structure not of masonry construction.

Each of the two environments listed above have different industry accepted methods of installation. Door and window frames in masonry constructed structures must be braced in the exact position, plumb and square, and must remain in that precise position as the masonry construction is completed around the supported frame. This procedure is very labor intensive as accuracy is essential for the proper operation and installation of the door, window or other component. It is quite common for misalignment to occur due to the braced frame being hit and moved during the masonry construction. Furthermore, the hits and scratches sustained by the frame during the construction process significantly increases the risk of rusting thereby requiring time consuming cleaning before the finish can be applied to the frame.

In many cases, access must be provided to allow filling the hollow metal jamb members with a cementaceous material to obtain rigidity. Any variation between the thickness of the masonry structure becomes very apparent at the point where the masonry wall meets the jamb members. In addition, the cementaceous fill is problematic when holes must be drilled into the jamb members to mount hardware thereon. The installer must drill through the jamb members and continue drilling into the cementaceous fill to allow the proper clearance for the screws to seat properly and not strip out. This activity causes the installer to use up an excessive number of expensive bits and often produces holes that are not suitable for screw retention.

In non-masonry construction, any deviation in the structure thickness will cause problems during the finishing process. A split door jamb installed during the "framing" period of construction is subject to being hit or moved out of plumb and square arrangement. If a split door jamb is to extend beyond the wall structure thickness, then the split door jamb must be installed and the structure surfaces must be finished up to the jamb members. This often results in the area where the jamb members and wall structure meet to be a weak point in the finish, causing problems in the life of the structure.

In an effort to overcome and eliminate the aforementioned problems, the present invention was conceived.

SUMMARY OF THE INVENTION

Therefore it is an object of the present invention to provide a split jamb for supporting doors, windows and other similar objects, within both masonry and non-masonry constructed structures, that is relatively easy to install and is less labor intensive than past split door jambs.

It is another object of the invention is to provide a split door jamb that can be installed after the completion of a wall structure thereby facilitating a plumb and square installation and allowing for the split door jamb to be installed in a "factory-finished" condition.

It is another object of the invention is to provide a split door jamb that can be installed in a wall structure so as to compensate for deviations in the construction of the wall structure.

It is another object of the invention is to provide a split door jamb having a unique mounting system that eliminates the need for a cementaceous filling to provide rigidity.

It is another object of the invention is to provide a split door jamb in which only the size of the trim piece needs to be changed in order to accommodate various jamb depths.

It is another object of the invention is to provide a split door jamb that can be removed and replaced without any disruption to the wall structure or fixture, and can likewise replace a conventional support frame in an existing structure without any disruption to the structure or finish.

It is another object of the invention is to provide a split door jamb having uniform integrated anchoring devices that eliminate the need for manufacturing different types of anchoring devices and greatly reduces the risk of losing them.

It is another object of the invention is to provide a split door jamb requiring fewer hardware reinforcements than conventional support frames.

It is another object of the invention is to provide a split door jamb and a method of using same that results in a finished installation.

These and other objectives of the present invention are achieved by providing a split door jamb comprising a support frame and a trim frame that are installed within an opening in a structure using a unique mounting system. The support frame comprises two vertical side frame members that are positioned on respective vertical sides of a structure opening. Each of the side frame members include at least one vertically spaced adjustable fastener for mounting the side frame members to the vertically extending walls of the structure that define the opening. One frame member has at least one hinge pad for carrying a door or similar object to cover the opening. Each of the side frame members carries an outwardly-extending elongate tongue and tongue fastener elements adjacent to the tongue. The vertical side frame members are connected by a laterally-extending top frame member, which also has an outwardly-extending elongate tongue.

The trim frame comprises two vertical side trim members that are mounted on and carried by respective side frame members of the support frame. Each trim member carries a outwardly-extending tongue receiver for being mated to and adjustably-receiving a tongue extending from a respective side frame member. Each trim member also carries fastener elements for complementary connection with the fastener elements carried by the side frame members to adjustably connect the trim frame and the support frame together to form a square and plumb split door jamb. The vertical side trim members are connected by a laterally-extending top trim member, which also an outwardly-extending tongue receiver.

According to one preferred embodiment of the invention, the split door jamb is comprised of metal.

According to another preferred embodiment of the invention, the split door jamb includes a plurality of second tongue fastener elements carried by the first and second tongue receivers for adjustably mating with the plurality of first tongue fastener elements for fixing the tongues and the tongue receivers in a desired position relative to each other.

According to yet another preferred embodiment of the invention, each of the first and second vertical side frame members include a plurality of vertically-spaced adjustable fasteners for mounting the first and second side frame members to first and second opposed, vertically-extending walls defining the opening plumb to the vertical.

According to yet another preferred embodiment of the invention, the first and second tongue receivers include a pair of adjacent, diverging tongue receiver strips between which the tongue is adjustably wedged for joining the first and second trim frames to the respective first and second support frames.

According to yet another preferred embodiment of the invention, the split door jamb includes a plurality of second tongue fastener elements carried by the first and second tongue receivers for adjustably mating with the plurality of first tongue fastener elements for fixing the tongues and the tongue receivers in a desired position relative to each other; and a flange carried by one of the first or second tongue receiver strips and extending outwardly in the direction of the wall defining the opening for carrying a second tongue fastener element.

According to yet another preferred embodiment of the invention, the split door jamb includes at least one vertically-spaced mounting bracket carrying an adjustable fastener for being positioned and supported against the vertically-extending walls defining the opening.

According to yet another preferred embodiment of the invention, the split door jamb includes a predetermined number of shims for being positioned between the mounting brackets and the walls defining the opening for allowing the support frame to be adjusted to a plumb position.

According to yet another preferred embodiment of the invention, a split door jamb comprising a support frame and a trim frame for being positioned in a predetermined size opening. The support frame includes first and second opposed frame members for being positioned on respective first and second opposed sides of the opening, each of said first and second vertical side frame members include at least one adjustable fastener for mounting the first and second side frame members to first and second opposed walls defining the opening. The first frame member includes at least one hinge pad for carrying a structure covering the opening thereon. The first and second outwardly-extending elongate tongues are carried respectively by said first and second frame members. A plurality of spaced-apart first tongue fastener elements are carried by the respective first and second frame members adjacent to the first and second tongues. A third frame member connects the first and second frame members and extends perpendicularly thereto.

According to yet another preferred embodiment of the invention, each of the first and second vertical side frame members include a plurality of vertically-spaced adjustable fasteners for mounting the first and second side frame members to first and second opposed walls defining the opening.

The trim frame includes first and second trim members for being mounted on and carried by respective first and second frame members. First and second elongate, vertically-extending tongue receivers are carried on the first and second trim members for being mated to and adjustably-receiving the respective first and second tongues. A plurality of spaced-apart trim frame fastener elements are carried by respective side trim members for complementary connection with the frame member fastener elements carried by the first and second members for adjustably connecting together the trim frame and the support frame to form a square and plumb split frame hollow metal opening assembly.

An embodiment of the method of installing a frame in an opening defined by walls according to the invention comprises the steps of providing a split frame hollow opening assembly for being positioned in predetermined size opening and comprising a support frame and a trim frame. The support frame includes first and second vertical side frame members for being positioned on respective first and second vertical sides of the opening, each of said first and second vertical side frame members including at least one vertically-spaced adjustable fastener for mounting the first and second side frame members to first and second opposed, vertically-extending walls defining the opening plumb to the vertical. The first frame member includes at least one hinge pad for carrying a structure to cover the opening thereon. First and second outwardly-extending elongate tongues are carried respectively by the first and second vertical side frame members; a plurality of spaced-apart first tongue fastener elements are carried by the respective side frame members adjacent to the first and second tongues. A laterally-extending top frame member connects the first and second vertically-extending side frame members perpendicularly thereto. The trim frame comprises first and second vertical side trim members for being mounted on and carried by respective first and second vertical side frame members. First and second elongate, vertically-extending tongue receivers are carried on the first and second trim members for being mated to and adjustably-receiving the respective first and second tongues. A plurality of spaced-apart trim frame fastener elements are carried by respective side trim members for complementary connection with the frame member fastener elements carried by the side frame members for adjustably connecting together the trim frame and the support frame to form a square and plumb split frame hollow metal opening assembly.

The support frame is positioned in the opening. The first and second side frame members are trued to the vertical plumb and square. The support frame is then secured to the walls defining the opening. The trim frame is positioned in the opening with the tongues of the respective first and second support frames received in the first and second tongue receivers. The trim frame is trued to the vertical. Finally, the support frame fastener elements are secured to the trim frame fastener elements to secure the support frame to the trim frame.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
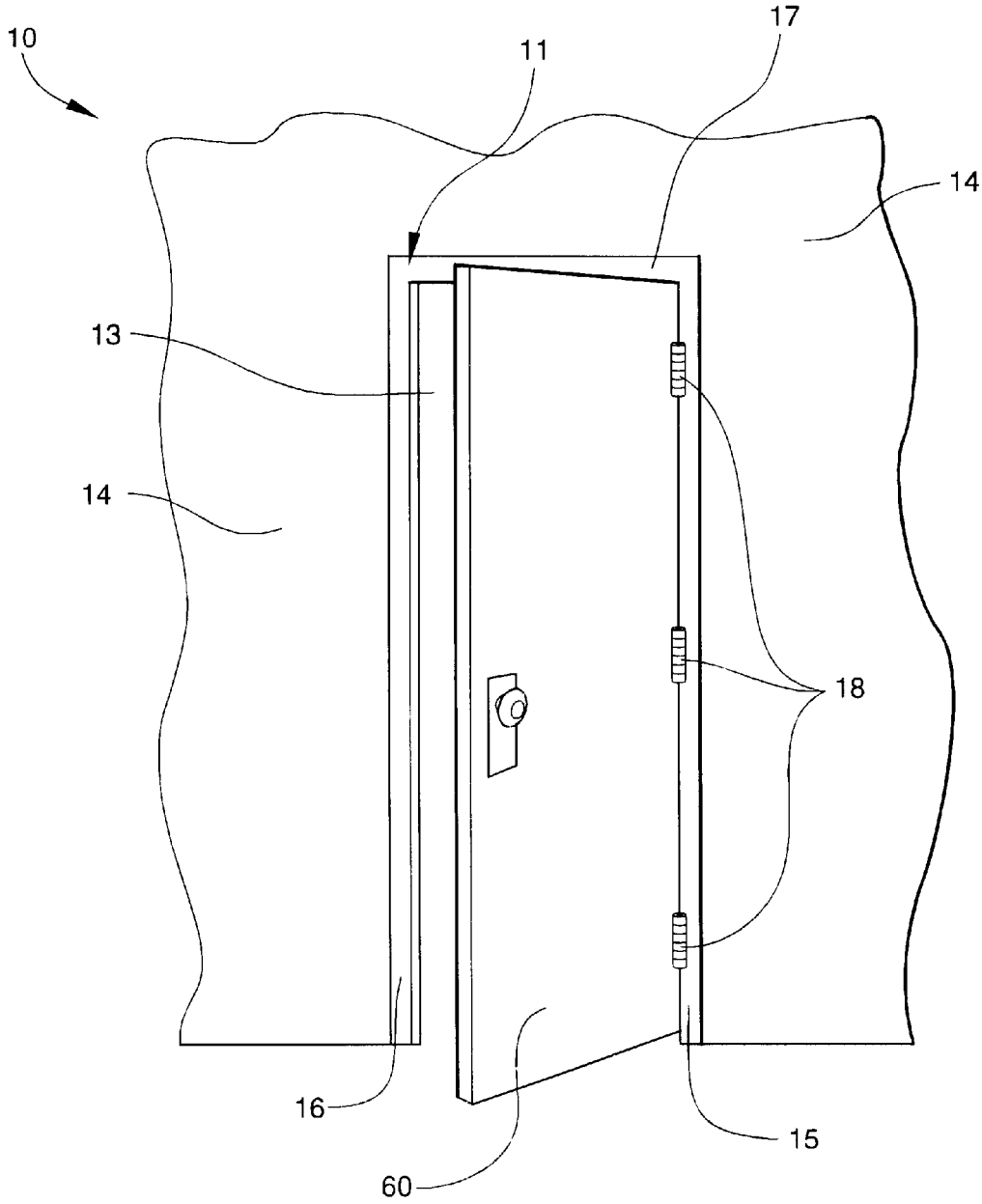
FIG. 1 is a front elevation of the split door jamb of the present invention installed in a door opening.
Figure 2:
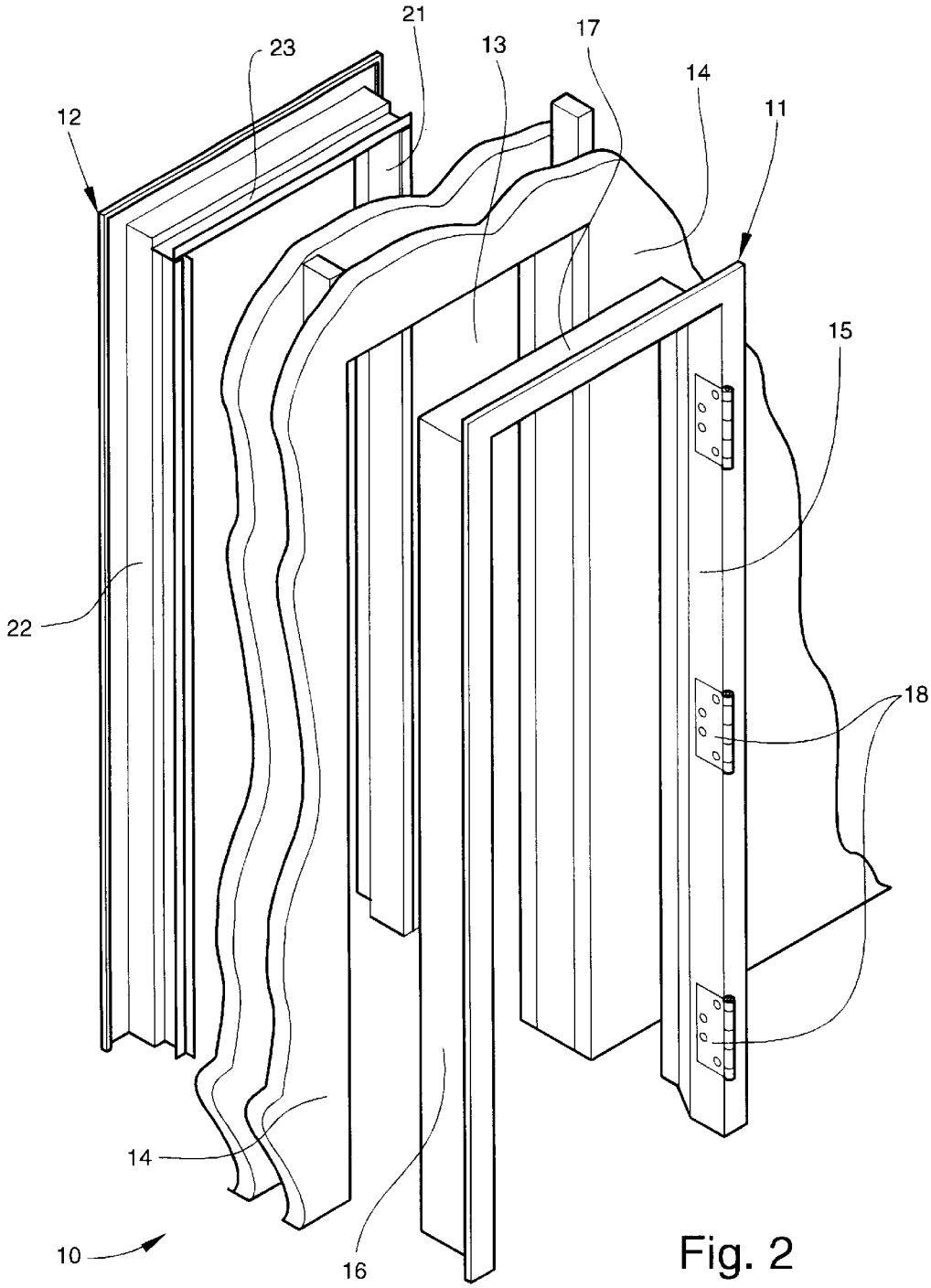
FIG. 2 is a perspective exploded view of an uninstalled split door jamb of the present invention.
Figure 3:
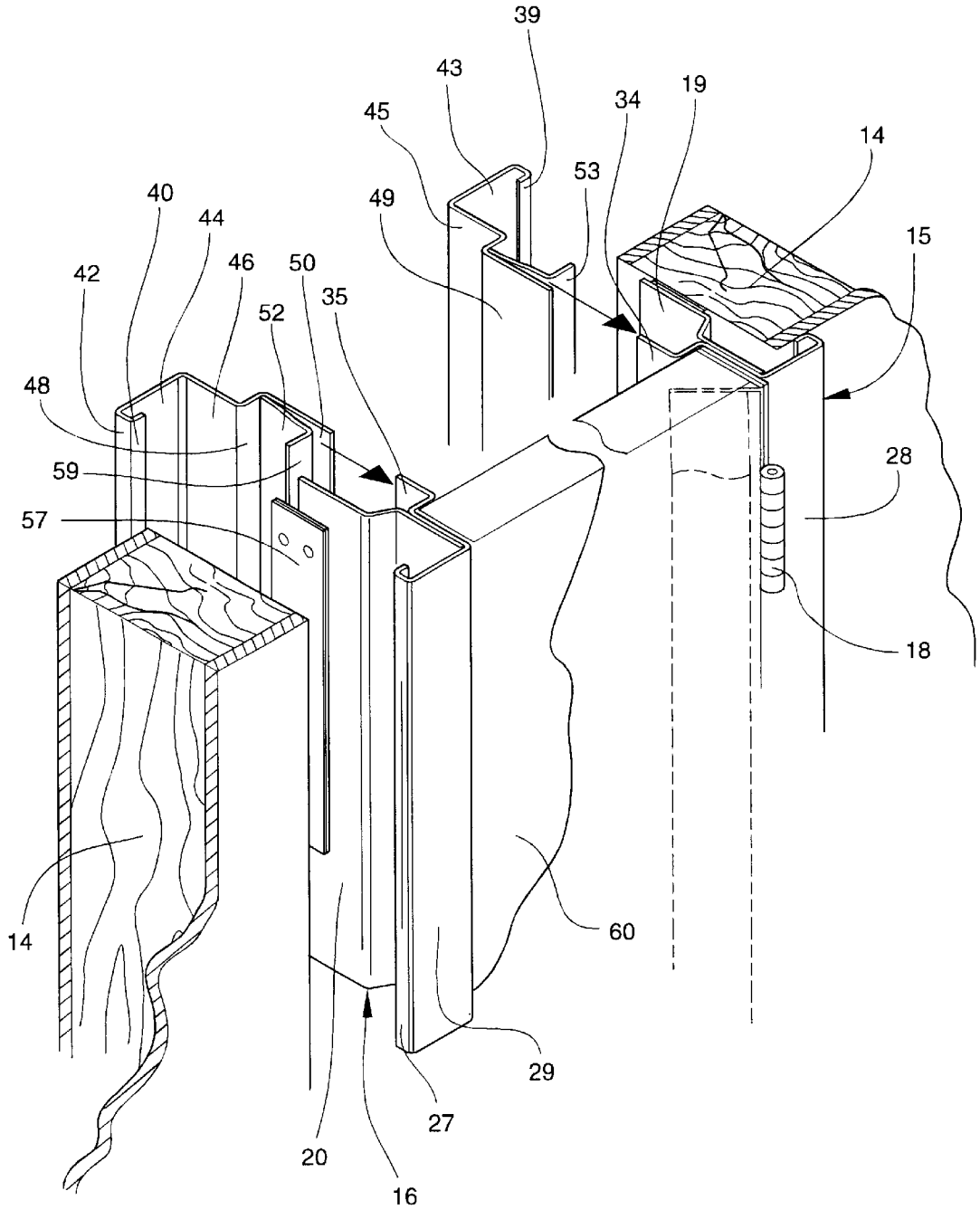
FIG. 3 is an exploded fragmentary perspective view of the split door jamb of the present invention.

Referring now specifically to the drawings, a preferred embodiment of the split door jamb according to the present invention in use is illustrated in FIGS. 1 and 2, and shown generally at reference numeral 10. FIG. 2 shows the preferred split door jamb 10 comprising a support frame 11 and a trim frame 12 positioned facing support frame 11 on the opposite side of a door opening 13 defined by a wall structure 14. Split door jamb 10 is hollow and preferably made of metal. Support frame 11 is located on the exterior side of the wall structure 14 and trim frame 12 is positioned on the interior side of wall structure 14. Support frame 11 comprises vertically extending side frame members 15, 16, which are connected by a laterally extending top frame member 17. The side frame members 15, 16 are parallel to each other and perpendicular to the top frame member 17. Hinge assemblies 18 are affixed to a side frame member 15. Although the hinge assemblies 18 are shown in FIG. 2 carrying a door, they can also carry a window or any other similar object for covering a structure opening. In addition, hinge assemblies 18 can be mounted on side frame member 15 rather than side frame member 16. Support frame 11 includes mounting brackets 19, 20 that are welded to the side frame members 15, 16, respectively, as shown in FIGS. 3 and 4.

As can be seen in FIG. 2, trim frame 12 comprises vertically extending side trim members 21, 22, which are connected by a laterally extending top trim member 23. The side trim members are parallel to each other and perpendicular to the top trim member 23.

Figure 4:
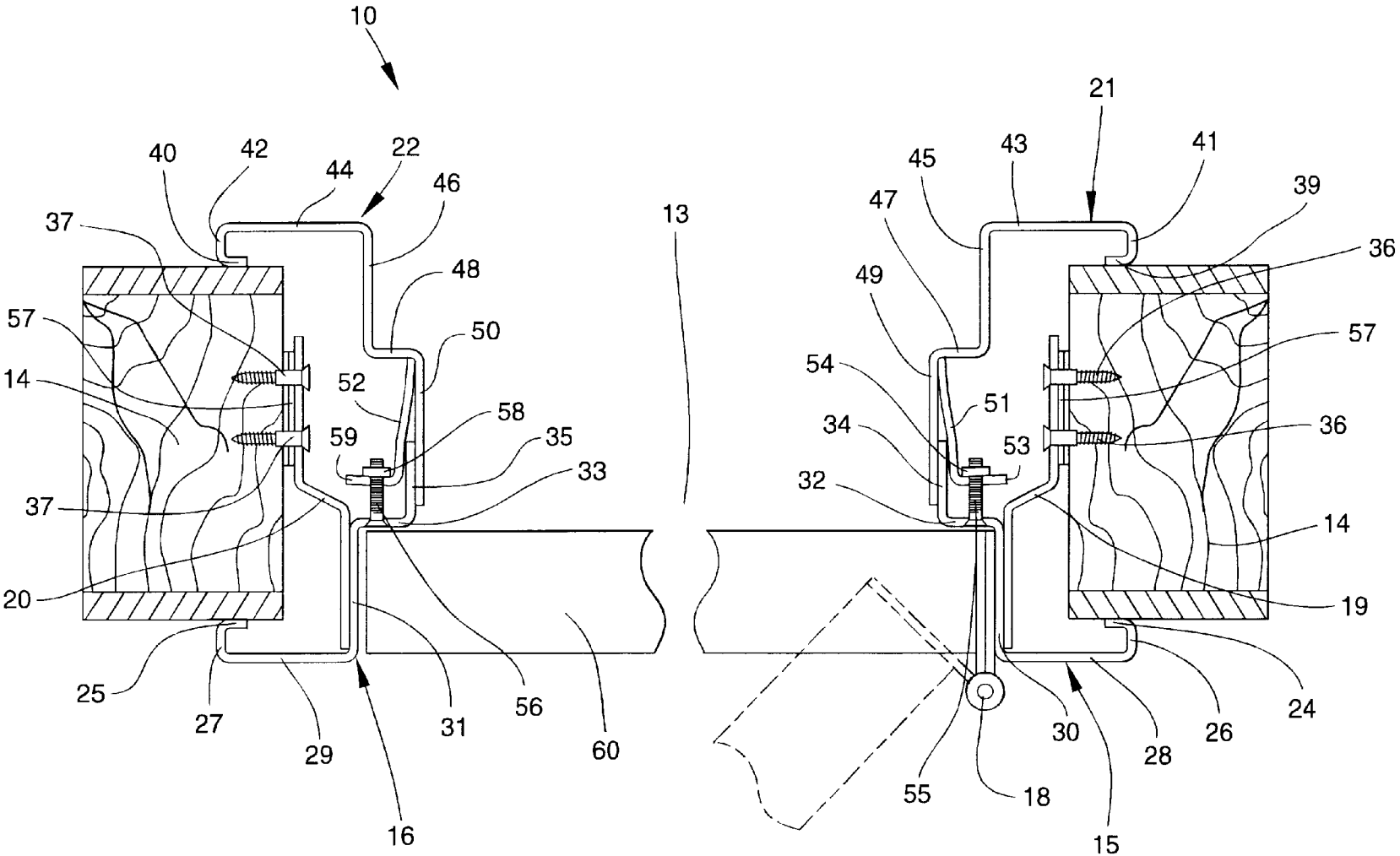
FIG. 4 is an enlarged fragmentary cross-sectional top view of an installed split door jamb of the present invention.

As best shown in FIG. 4, side frame members 15, 16 comprise returns 24, 25, reveals 26, 27, frame faces 28, 29, rabbetts 30, 31, active stops 32, 33 and tongue members 34, 35, respectively. With the exception of features specifically related to the hinge assemblies 18 affixed to side frame member 15 only, the side frame members 15 and 16 are identical in design. As such, the following description of side frame member 15 is generally applicable to side frame member 16.

As seen in FIG. 4, return 24 of side frame member 15 contacts wall structure 14 and extends perpendicularly from reveal 26 towards the opening 13. Frame face 28 extends perpendicularly from reveal 26 towards the opening 13 and is parallel to return 24. Rabbett 30 extends perpendicularly from frame face 28 and is parallel to reveal 26. Active stop 32 extends perpendicularly from rabbett 30 and is parallel to frame face 28. Tongue member 34 extends perpendicularly from active stop 32 towards the interior side of the wall structure 14 and is parallel to reveal 26 and rabbett 30. Active stop 32 can include a slight roll or beaded caulk that extends outward therefrom and adjacent to tongue member 34, terminating at the edge of the stop face 49 of the trim frame 12 to eliminate any protruding edge. Top frame member 17 is of a similar design and construction as side frame member 15, and also comprises a tongue member. The mounting bracket 19 is welded to the rabbett 30 and defines holes for inserting anchoring devices 36 to affix the mounting bracket to the wall structure 14.

The mounting bracket 19 is welded to the rabbett 30 on the side opposite of the hinge assemblies 17 at intervals equal to the spacing of the hinge assemblies 18 so as to correspond with each other. Rabbett 30 has depressed cut out areas with perforations for receiving hinge assemblies 18. In addition, mounting bracket 19 has depressed perforated hinge pad areas that correspond with the depressed cut out areas. It should be noted that rabbett 31 on side frame member 16 does not have any depressed cut out areas, nor does, mounting bracket 20 have any depressed perforated hinge pad areas.

Side trim members 21, 22 comprise returns 39, 40, reveals 41, 42, frame faces 43, 44, rabbetts 45, 46, inactive stops 47, 48, stop faces 49, 50, tongue receivers 51, 52, and leg portions 53, 59, respectively. Side trim members 21, 22 are identical in design, and therefore, the following description of side trim member 21 is also applicable to side trim member 22.

As can be seen in FIG. 4, return 39 of trim member 21 contacts wall structure 14 and extends perpendicularly from reveal 41 toward opening 13. Frame face 43 extends perpendicularly from reveal 41 towards opening 13 and is parallel to return 39. Rabbett 45 extends perpendicularly from frame face 43 towards the exterior side of wall structure 14, and is parallel to reveal 41. Inactive stop 47 extends perpendicularly from rabbett 45 and is parallel to frame face 43. Stop face 49 extends perpendicularly from inactive stop 47 and is parallel to rabbett 45. Tongue receiver 51 is welded at a point where inactive stop 47 meets stop face 49 to form a cavity in which to receive the tongue member 34 of side frame member 15. Top trim member 23 is of similar design and construction as trim member 21, and also comprises a cavity in which to receive the tongue member of top frame member 17. The tongue receiver 51 includes a leg portion 53 which contains a retainer 54. The retainer 54 is positioned within the leg portion 53 to correspond with and engage an adjusting and securing device 55 that is countersunk into a hole defined by the active stop 32 of the support frame 11. In the preferred embodiment, the adjusting and securing device 55 comprises a machine screw.

To assemble the split door jamb 10, the support frame 11 is positioned in front of a door opening 13 on the exterior side of a wall structure 14, as shown in FIG. 2. The trim frame 12 is positioned facing the support frame 11 on the interior side of the wall structure. The support frame is moved into a plumb and square position with the door opening 13 such that reveals 26, 27 contact the wall structure 14, as seen in FIG. 3. The plumb and square position of the support frame 11 is determined using industry accepted methods of installation that vary depending on the type of structure, masonry or non-masonry, on which the split door jamb 10 is being mounted.

As can be seen in FIG. 4, anchoring devices 36, 37 are installed through holes defined by the mounting brackets 19, 20, respectively. The mounting brackets 19, 20 are not contiguous with the entire length of the side frame members 15, 16. The mounting brackets 19, 20 are preferably 12 inches in vertical length. The anchoring devices 36, 37 are preferably integrated into the mounting brackets 19, 20 with hinge reinforcements. The anchoring devices 36, 37 vary depending on the material of the wall structure 14 on which the support frame 11 is being mounted. For instance, anchoring devices 36 would preferably comprise wood screws when the wall structure 14 is of wood construction. The anchoring devices 36 are then inserted through a desired number of shims 57 that are positioned between the mounting brackets 19, 20, thereby altering the position of the split door jamb 10 in relation to the wall structure 14. This feature of the invention enables the split door jamb 10 to be used in openings 13 of various widths. Next, the anchoring devices 36, 37 are driven into the wall structure 14 thereby securing the support frame 11 to the door opening 13. Since the split door jamb 10 is mounted in an active process, physically attached to the wall structure 14 with anchoring devices 36, 37, there is no need for cementaceous filling material. As such, the split door jamb 10 can be quickly and easily removed without any disruption to the existing structure and finishes.

Figure 5:
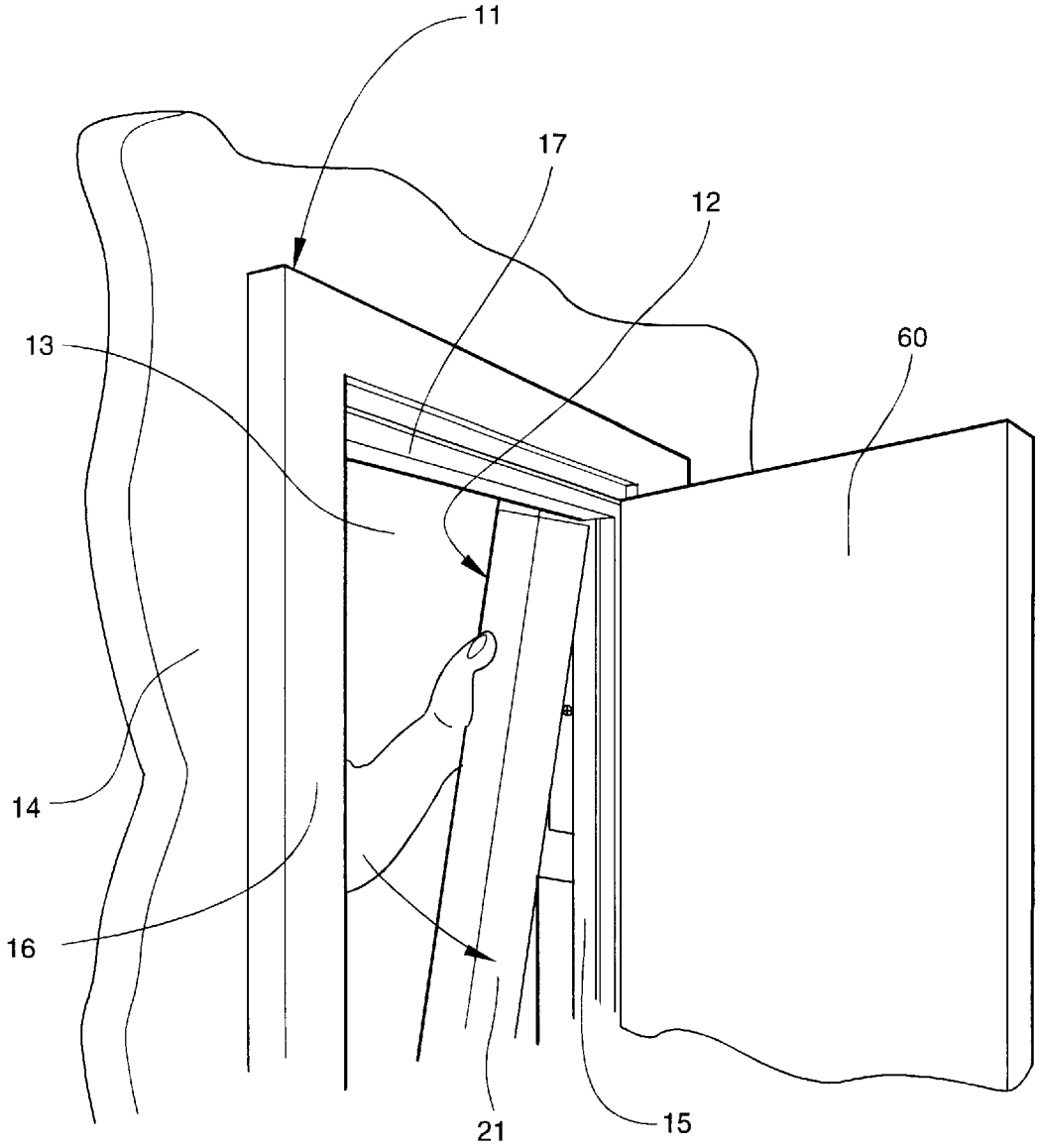
FIG. 5 is a partial perspective view of the split door jamb being installed.
Figure 6:
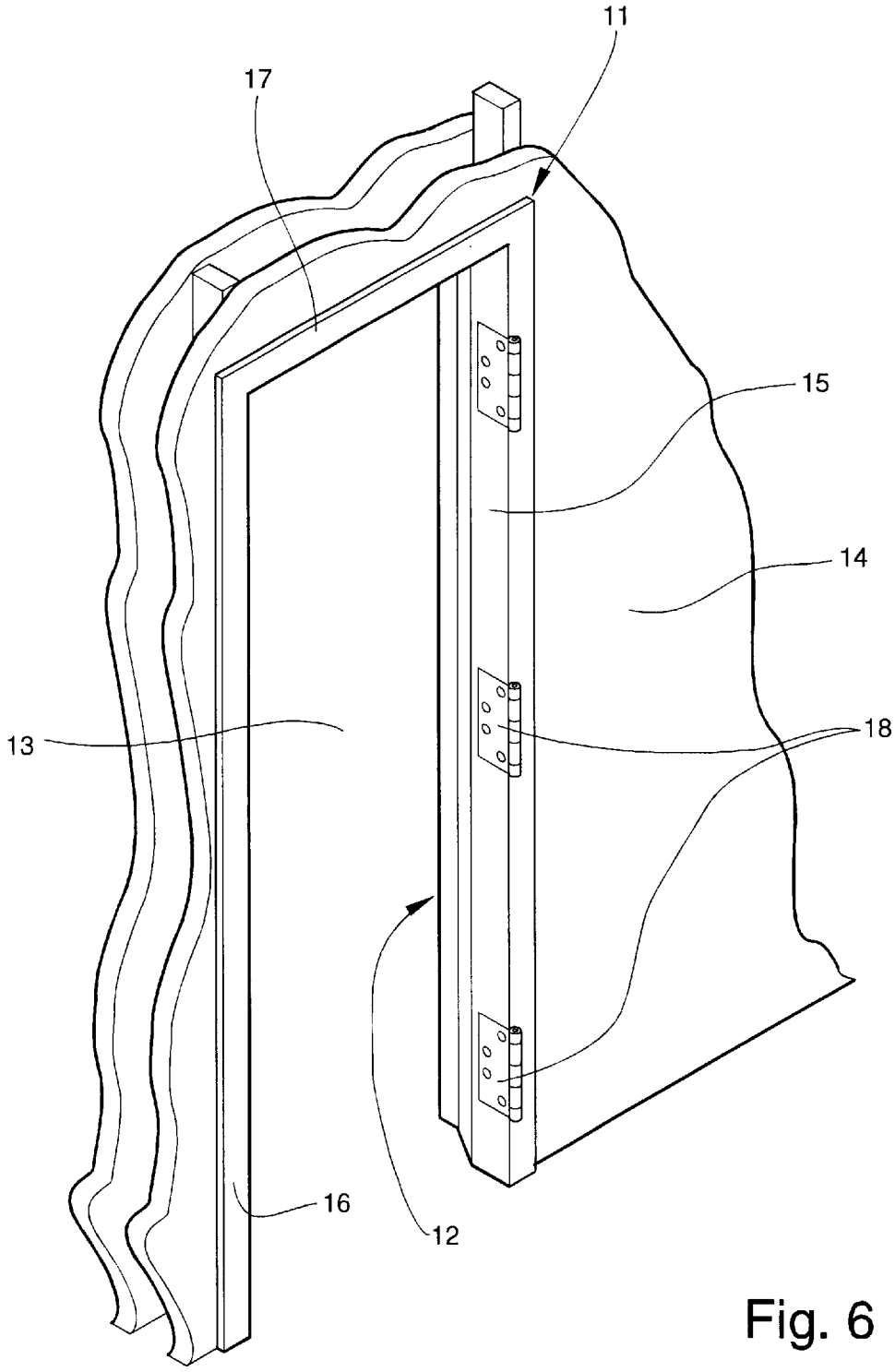
FIG. 6 is a perspective view of an installed split door jamb of the present invention.

At this point, the trim frame 12 can now be installed. The trim frame 12 is positioned facing the support frame 11 such that the tongue members of the support frame are aligned with the receiving cavities of the trim frame, as illustrated in FIG. 2. Once this alignment is accomplished, a slight amount of forward pressure, towards the support frame 11, is applied to the trim frame 12 starting at the top and continuing to the bottom, as illustrated in FIG. 5. This causes the receiving cavities of trim frame 12 to capture the tongue members of support frame 11. Once the tongue members of the support frame 11 have been completely received by the trim frame 12, the adjusting and securing devices 55, 56 are inserted into holes defined by the active stops 32, 33, respectively, of the support frame 11, and positioned to engage the retainers 54, 58, respectively, of the trim frame 12. Upon engagement, the trim frame 12 is secured to the support frame 11 and can be adjusted to a desired position relative thereto, thereby enabling the support frame 11 to be used on structure openings of various depths. At this point, the installation of the split door jamb 10 is complete (see FIG. 6) and a door 60 can be mounted on hinges 18 (as shown in FIG. 1).

Because the split door jamb 10 can be installed in a finished wall structure, it can be produced as a factory finished unit. In addition, the need for specially made parts is greatly reduced since various jamb depths and widths can be accommodated by the split door jamb 10. As such, the split door jamb 10 can be adjusted to conform to variations in the door opening 13 of the wall structure 14 while maintaining the proper tolerance required to install the door 60 within industry specifications. This alleviates the need for exacting dimensions and greatly reduces the labor intensity of door installation.

A split door jamb and method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A split frame hollow opening assembly for being positioned in a predetermined size opening and comprising:

(a) a support frame, comprising:.

(i) first and second vertical side frame members for being positioned on respective first and second vertical sides of the opening, each of said first and second vertical side frame members including at least one vertically-spaced adjustable fastener for mounting the first and second side frame members to first and second opposed, vertically-extending walls defining the opening plumb to the vertical;

(ii) said first frame member including at least one hinge pad for carrying a structure covering the opening thereon;

(iii) first and second outwardly-extending elongate tongues carried respectively by said first and second vertical side frame members;

(iv) a plurality of spaced-apart first tongue fastener elements carried by said respective side frame members adjacent said first and second tongues; and (v) a laterally-extending top frame member connecting the first and second vertically-extending side frame members perpendicular thereto; and (b) a trim frame, comprising:

(i) first and second vertical side trim members for being mounted on and carried by respective first and second vertical side frame members;

(ii) first and second elongate, vertically-extending tongue receivers carried on said first and second trim members for being mated to and adjustably-receiving the respective first and second tongues;

(iii) a plurality of spaced-apart trim frame fastener elements carried by respective side trim members for complementary connection with the frame member fastener elements carried by the side frame members for adjustably connecting together the trim frame and the support frame to form a square and plumb split frame hollow metal opening assembly.

2. A door frame opening assembly according to claim 1, wherein said door frame assembly is comprised of metal.

3. A door frame opening assembly according to claim 1, and including a plurality of second tongue fastener elements carried by said first and second tongue receivers for adjustably mating with said plurality of first tongue fastener elements for fixing said tongues and said tongue receivers in a desired position relative to each other.

4. A door frame opening assembly according to claim 1, wherein each of said first and second vertical side frame members include a plurality of vertically-spaced adjustable fasteners for mounting the first and second side frame members to first and second opposed, vertically-extending walls defining the opening plumb to the vertical.

5. A door frame opening assembly according to claim 1, wherein said first and second tongue receivers comprise a pair of adjacent, diverging tongue receiver strips between which the tongue is adjustably wedged for joining the first and second trim frames to the respective first and second support frames.

6. A door frame opening assembly according to claim 5, and including:

(a) a plurality of second tongue fastener elements carried by said first and second tongue receivers for adjustably mating with said plurality of first tongue fastener elements for fixing said tongues and said tongue receivers in a desired position relative to each other; and (b) a flange carried by one of the first or second tongue receiver strips and extending outwardly in the direction of the wall defining the opening for carrying a second tongue fastener element.

7. A door frame opening assembly according to claim 1, and including at least one vertically-spaced mounting bracket carrying said adjustable fasteners for being positioned and supported against the vertically-extending walls defining the opening.

8. A door frame opening assembly according to claim 7, and including shims for being positioned between the mounting brackets and the walls defining the opening for allowing the support frame to be adjusted to a plumb position.

9. A split frame hollow metal opening assembly for being positioned in a predetermined size opening and comprising:

(a) a support frame, comprising:

(i) first and second opposed frame members for being positioned on respective first and second opposed sides of the opening, each of said first and second vertical side frame members including at least one adjustable fastener for mounting the first and second side frame members to first and second opposed walls defining the opening;

(ii) said first frame member including at least one hinge pad for carrying a structure covering the opening thereon;

(iii) first and second outwardly-extending elongate tongues carried respectively by said first and second frame members;

(iv) a plurality of spaced-apart first tongue fastener elements carried by said respective first and second frame members adjacent said first and second tongues; and (v) a third frame member connecting the first and second frame members perpendicular thereto; and (b) a trim frame, comprising:

(i) first and second trim members for being mounted on and carried by respective first and second frame members;

(ii) first and second elongate, vertically-extending tongue receivers carried on said first and second trim members for being mated to and adjustably-receiving the respective first and second tongues;

(iii) a plurality of spaced-apart trim frame fastener elements carried by respective side trim members for complementary connection with the frame member fastener elements carried by the first and second members for adjustably connecting together the trim frame and the support frame to form a square and plumb split frame hollow metal opening assembly.

10. A door frame opening assembly according to claim 9, wherein said door frame assembly is comprised of metal.

11. A door frame opening assembly according to claim 9, and including a plurality of second tongue fastener elements carried by said first and second tongue receivers for adjustably mating with said plurality of first tongue fastener elements for fixing said tongues and said tongue receivers in a desired position relative to each other.

12. A door frame opening assembly according to claim 9, wherein each of said first and second vertical side frame members include a plurality of vertically-spaced adjustable fasteners for mounting the first and second side frame members to first and second opposed walls defining the opening.

13. A door frame opening assembly according to claim 9, wherein said first and second tongue receivers comprise a pair of adjacent, diverging tongue receiver strips between which the tongue is adjustably wedged for joining the first and second trim frames to the respective first and second support frames.

14. A door frame opening assembly according to claim 13, and including:

(a) a plurality of second tongue fastener elements carried by said first and second tongue receivers for adjustably mating with said plurality of first tongue fastener elements for fixing said tongues and said tongue receivers in a desired position relative to each other; and (b) a flange carried by one of the first or second tongue receiver strips and extending outwardly in the direction of the wall defining the opening for carrying a second tongue fastener element.

15. A door frame opening assembly according to claim 9, and including a plurality of mounting brackets carrying said adjustable fasteners for being positioned and supported against the opposed walls defining the opening.

16. A door frame opening assembly according to claim 15, and including shims for being positioned between the mounting brackets and the walls defining the opening for allowing the support frame to be adjusted to a desired position.

17. A method of installing a frame in an opening defined by walls, and comprising the steps of:

(a) providing a split frame hollow opening assembly for being positioned in predetermined size opening and comprising:

(i) a support frame, comprising first and second vertical side frame members for being positioned on respective first and second vertical sides of the opening, each of said first and second vertical side frame members including at least one vertically-spaced adjustable fastener for mounting the first and second side frame members to first and second opposed, vertically-extending walls defining the opening plumb to the vertical; said first frame member including at least one hinge pad for carrying a structure to cover the opening thereon; first and second outwardly-extending elongate tongues carried respectively by said first and second vertical side frame members; a plurality of spaced-apart first tongue fastener elements carried by said respective side frame members adjacent said first and second tongues; and a laterally-extending top frame member connecting the first and second vertically-extending side frame members perpendicular thereto; and (b) a trim frame, comprising first and second vertical side trim members for being mounted on and carried by respective first and second vertical side frame members; first and second elongate, vertically-extending tongue receivers carried on said first and second trim members for being mated to and adjustably-receiving the respective first and second tongues; and a plurality of spaced-apart trim frame fastener elements carried by respective side trim members for complementary connection with the frame member fastener elements carried by the side frame members for adjustably connecting together the trim frame and the support frame to form a square and plumb split frame hollow metal opening assembly;

(c) positioning the support frame in the opening;

(d) trueing the first and second side frame members to the vertical plumb and square;

(e) securing the support frame to the walls defining the opening;

(f) positioning the trim frame in the opening with the tongues of the respective first and second support frames received in the first and second tongue receivers;

(g) trueing the trim frame to the vertical; and (h) securing the support frame fastener elements and the trim frame fastener elements to each other to secure the support frame to the trim frame.

* * * * *